US005836319A

United States Patent [19]

Lombardi

[11] Patent Number: 5,836,319

[45] Date of Patent: Nov. 17, 1998

[54] TAR-LIKE COSMETIC COMPACT HAVING A CYLINDRICAL PULL-OUT DRAWER

[76] Inventor: Carl M. Lombardi, 424 W. Neck Rd., Lloyd Harbor, N.Y. 11743

[21] Appl. No.: 795,426

[22] Filed: Feb. 5, 1997

[51] Int. Cl.[6] ..... A45D 33/20

[52] U.S. Cl. ..... 132/287; 132/294; 132/305

[58] Field of Search ..... 132/287, 293, 132/294, 295, 300, 301, 303, 305, 314, 297; 206/823, 235, 581; D28/82, 78

*Primary Examiner*—Jeffrey A. Smith

*Assistant Examiner*—Eduardo C. Robert

*Attorney, Agent, or Firm*—Michael Ebert

[57] ABSTRACT

A travel cosmetic compact which in a single jar-like package supplies its user with a facial cosmetic, an applicator therefor and a mirror. The compact includes an upper section having a cylindrical shell adapted to accommodate a cosmetic, such as a pressed powder pad, and a lid screwed onto the shell to hermetically seal the cosmetic. Integrated with the upper section is a lower section defining a cylindrical chamber having an opening inlet to admit a cylindrical pull-out drawer adapted to accommodate a mirror and an applicator for the cosmetic, such as a powder puff.

7 Claims, 2 Drawing Sheets

TAR-LIKE COSMETIC COMPACT HAVING A CYLINDRICAL PULL-OUT DRAWER

BACKGROUND OF INVENTION

1. Field of Invention

This invention relates generally to compacts for cosmetics, and in particular to a travel cosmetic compact which provides its user in a single jar-like package with a facial cosmetic, an applicator therefor and a mirror.

2. Status of Prior Art

The term makeup, in the sense this term is used in connection with cosmetics, encompasses the full range of cosmetics employed by women to beautify and color their faces. Included, therefor are lipstick, blusher, mascara and eye shadow, as well as pressed facial powders. In some instances, these cosmetics may be applied by a finger to the user's face and in other by brushes and other cases types of applicators.

Because of the assortment of cosmetic makeup items available to the modern woman, these items are usually deployed on a mirrored dressing table, or they are stored in a cosmetic cabinet or on a shelf. But when away from home, the woman will usually only take along in her purse or handbag the one or two cosmetic items she needs for a particular occasion to touch up her face. Thus when attending a party, she may bring with her only a powder compact and a lipstick.

The typical facial powder compact takes the form of an oyster-shaped container having a supply of pressed powder and a hinged lid on whose inner wall is mounted a small mirror. Not only is this compact relatively bulky, but it houses far more powder than necessary for a given occasion. Also, when the compact is shut, the mirror then overlies the powder supply, and unless a removable cover is provided for the powder supply, the mirror will become clouded with powder, and it becomes difficult to view the face in the mirror.

In the portable cosmetic case disclosed in the Tsuji et al. U.S. Pat. No. 4,526,273, box-like hollow case is provided, one end of which is open to receive a sliding drawer containing compacted face powder. Attached to the outer face of the top wall of the case is a mirror that is always exposed regardless of whether the drawer is pushed in or pulled out. Hence the mirror remains unprotected even when the compact is shut and is being transported. This mirror is not only subject to breakage, but also tends to gather dirt on its surface.

In the Lombardi Jr. U.S. Pat. No. 5,163,457 there is disclosed a travel compact having a rectangular case and a drawer therein for housing a cosmetic supply and a mirror, both of which in a storage mode of the compact are encased therein. The supply and the mirror are both exposed in a utility mode whereby the user may then view her face as she applies the cosmetic thereto.

The typical modern woman tends to stuff her purse or handbag with a wallet, a packet of tissues, eyeglasses, a comb, a brush, and an assortment of other items; as a consequence of which space in the purse is in short supply. It is desirable, therefore, that a travel compact include all necessary items, yet be as small as possible so that it occupies little space in the woman's purse or handbag.

A travel compact of the type disclosed in the Lombardi, Jr. patent is relatively bulky and is not always suitable for a small purse or handbag. Moreover, the cosmetic stored in this compact is not in the storage mode of the compact hermetically sealed. Hence if the stored cosmetic includes volatile agents, such as oils, these are free to evaporate, causing the facial cosmetic to dry out and become unusable or difficult to apply.

SUMMARY OF INVENTION

In view of the foregoing, the main object of this invention is to provide a travel cosmetic compact that occupies little space in a purse or handbag, yet includes an adequate supply of a cosmetic, as well as an applicator therefor and a mirror.

More particularly, an object of this invention is to provide a jar-like travel cosmetic compact of the above type in which the cosmetic is stored in an upper section of the compact and the mirror and applicator in a pull-out drawer in a lower section.

A significant feature of a compact in accordance with the invention is that the upper section of the compact in which the cosmetic is stored includes a cylindrical shell provided with a removable lid which when tightened on the shell then hermetically seals the cosmetic and thereby prevents the evaporation therefrom of volatile agents.

Also an object of the invention is to provide a compact whose components are all moldable of synthetic plastic material and can be mass-produced at relatively low cost.

Briefly stated, these objects are attained by a travel cosmetic compact which in a single jar-like package supplies its user with a facial cosmetic, an applicator therefor and a mirror. The compact includes an upper section having a cylindrical shell adapted to accommodate a cosmetic, such as a pressed powder pad, and a lid screwed onto the shell to hermetically seal the cosmetic. Integrated with the upper section is a lower section defining a cylindrical chamber having an opening to admit a cylindrical pull-out drawer adapted to accommodate a mirror and an applicator for the cosmetic, such as a powder puff.

BRIEF DESCRIPTION OF DRAWINGS

For a better understanding of the invention, as well as other objects and features thereof, reference is made to the accompanying drawings wherein.

DESCRIPTION OF DRAWING

Figure 1:
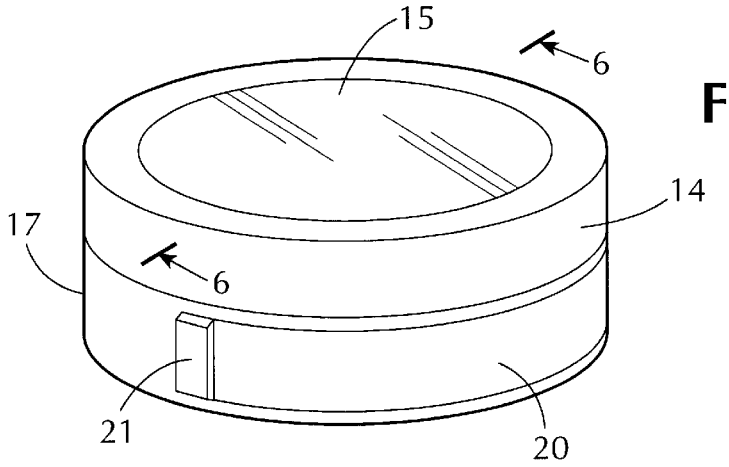
FIG. 1 is a perspective view of a jar-like travel cosmetic compact in accordance with the invention as it appears in its storage mode.
Figure 6:
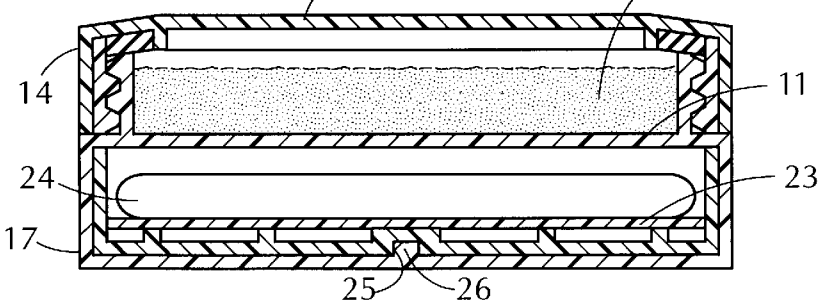
FIG. 6 is a section taken through the travel compact in its storage mode.
Figure 2:
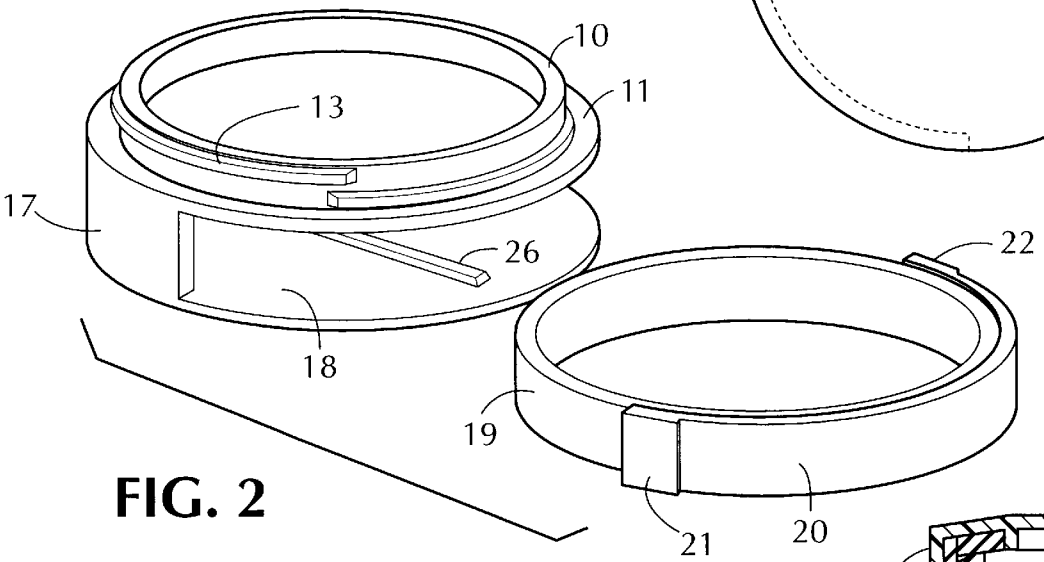
FIG. 2 shows the compact in its active mode with the lid removed from its upper section to expose the cosmetic, and with the pull-out drawer withdrawn from its lower section.

Referring now to FIGS. 1 and 6, there is shown in the figures a jar-like travel cosmetic compact in accordance with the invention which in practice may be molded entirely of high-strength synthetic plastic material, such as polypropylene or polyethylene.

The compact includes an upper section formed by a cylindrical shell 10 mounted on a circular base 11. Snugly received in the shell is a cosmetic, such as a circular pad 12 of pressed powder. Shell 10 is provided with an external thread 13 to receive a screw-on cylindrical lid 14. Inset in the top wall of the lid a disc-shaped transparent plastic window 15 which exposes the cosmetic stored in the upper section. Thus when the compact is in its storage mode as shown in FIG. 1, the cosmetic stored therein is visible through the window so that the user knows the extent to which the cosmetic is used up.

Figure 3:
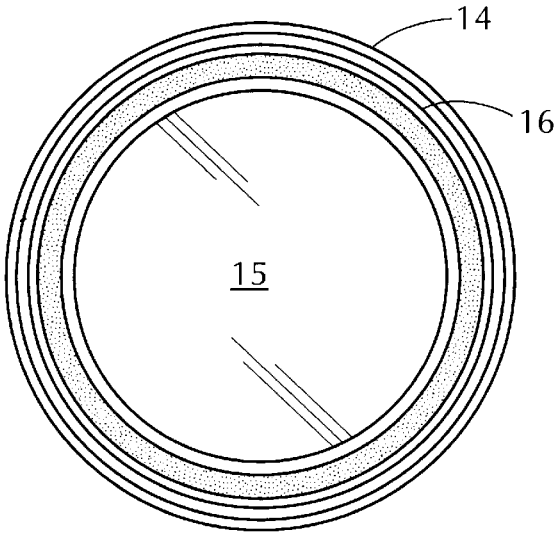
FIG. 3 is a plan view of the interior of the lid.

As shown in FIG. 3, seated within the interior of lid 14 adjacent its circular rim is a sealing ring 16 which is concentric with transparent disc 15. When lid 14 screwed onto shell 10 and is tightened, ring 16 then engages the circular edge of the shell to effect a hermetic seal of the upper section.

Ring 16 is made of an elastomeric substance, such as in a compressible O-ring, and it acts to prevent volatile agents included in the cosmetic stored in the upper section of the compact from evaporating when the compact is in its storage mode as shown in FIGS. 1 and 6. In practice any other means, such as plastic or paper liners can be used to effect a hermetic seal.

Integral with the upper section of the compact and coaxial therewith is a lower section 17 defining a circular chamber having a semi-circular opening 18 to admit therein a circular pull-out drawer 19. Drawer 19 is provided along that portion of its circular wall that is exposed by the opening 18, with an arcuate outer strip 20 having on either end finger ledges 21 and 22 to facilitate manual operation of the pull-out drawer.

Figure 4:
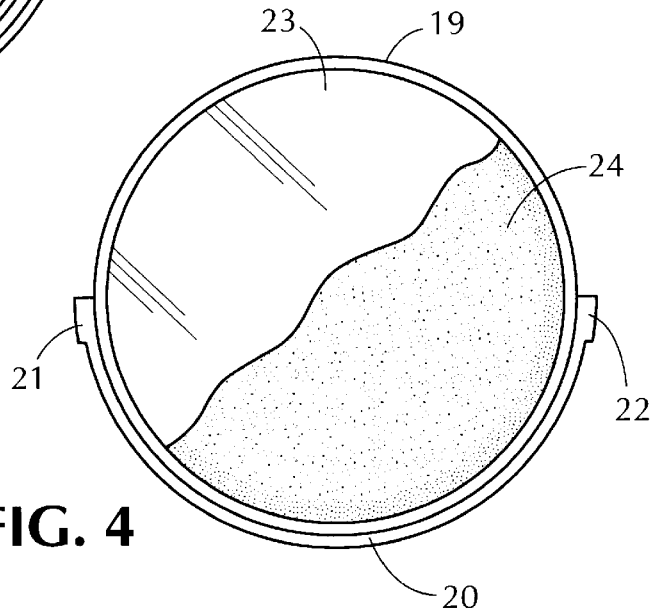
FIG. 4 shows the contents of the pull-out drawer.

Seated on the bottom of drawer 19, as shown in FIG. 4, in a disc-shaped mirror 23. When therefore the compact is in an active mode with lid 14 screwed off the upper section to make available the cosmetic, the user who applies with one hand the cosmetic to her face with an applicator, can by holding the drawer with her other hand look into the mirror. Placed in the drawer is a removable applicator which is shown as a soft powder puff 24 to apply powder taken from the upper section to the face.

Figure 5:
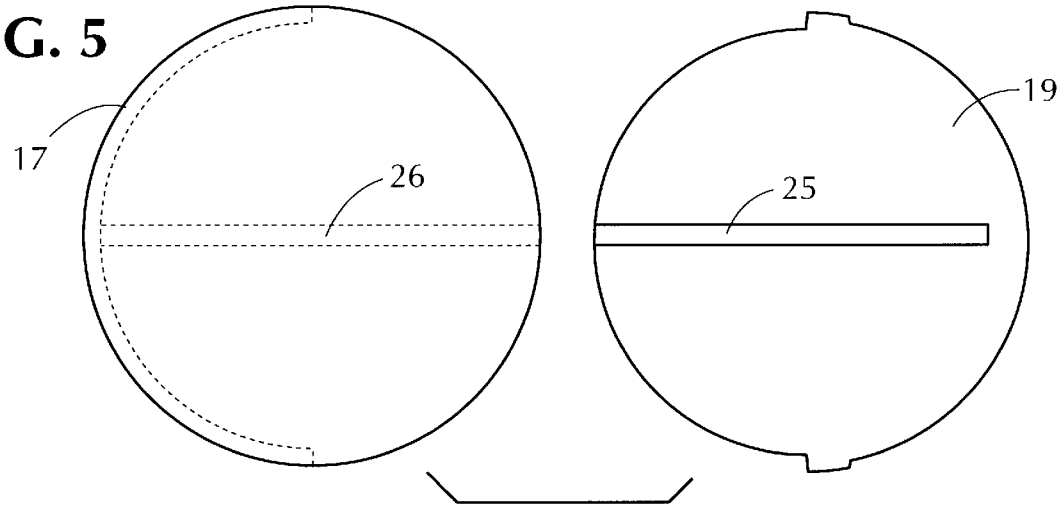
FIG. 5 shows the bottom of the pull-out drawer in relation to the bottom of the chamber in the lower section of the compact in which the drawer is received.

To properly orient pull out drawer 19, it is provided at its circular bottom, as shown in FIG. 5 with a groove 25 which runs along the diameter of the bottom. The bottom wall of the circular chamber in the lower section in which the drawer is received, is provided with a rib 26 which runs along its diameter. When drawer 19 slides into the chamber, groove 25 receives rib 26 to maintain the drawer properly oriented.

A drum-like travel compact in accordance with the invention combines in a single package whatever a user needs to apply a cosmetic to her face, for in the active mode of the compact, the user has available a cosmetic, an applicator therefor and a mirror to observe the application of the cosmetic to her face. In the storage mode, the compact resumes its drum-like form and the cosmetic is then hermetically sealed.

While there has been shown and described a preferred embodiment of a travel cosmetic compact in accordance with the invention, it will be appreciated that many changes may be made thereon without departing from the spirit of the invention.

I claim:

1. A jar-like travel cosmetic compact comprising:

A. an upper section having an open top cylindrical shell accommodating a cosmetic, and a screw-on circular lid to enclose the shell;

B. a lower section integral with the upper section and defining a cylindrical chamber having a semi-circular opening to admit a cylindrical pull-out drawer; and C. a cylindrical pull-out drawer containing a mirror affixed to a bottom of said drawer and an applicator for the cosmetic insertable through said opening into said chamber.

2. A compact as set forth in claim 1, in which said lid has a transparent plastic top to expose the cosmetic housed in the shell.

3. A compact as set forth in claim 1, in which said lid has a top wall on whose underside is a compressible ring which when the lid is tightened engages an edge of the shell to hermetically seal the upper section.

4. A compact as set forth, in claim 1 in which the upper and lower sections are molded of synthetic plastic material.

5. A compact as set forth in claim 1, wherein a bottom of said cylindrical drawer has a diametrical groove therein to receive a diametrical rib on a bottom of the chamber to properly orient the drawer as it is being pushed into or pulled out of the chamber.

6. A compact as set forth in claim 1, in which the cosmetic is a pressed-powder pad nested in the shell.

7. A compact as set forth in claim 6, in which the applicator is a powder puff.

* * * * *